US008037819B2

(12) United States Patent
Zanoli et al.

(10) Patent No.: US 8,037,819 B2
(45) Date of Patent: Oct. 18, 2011

(54) MACHINE FOR IN-REGISTER MOUNTING OF FLEXOGRAPHIC PRINTING PLATES

(75) Inventors: Alberto Zanoli, Sala Bolognese (IT); Stefano Sambri, S. Lazzaro Di Savena (IT)

(73) Assignee: Bieffebi S.p.A., Granarolo Dell'Emilia—Frazione Quarto Inferiore (IT)

( * ) Notice: Subject to any disclaimer, the term of this patent is extended or adjusted under 35 U.S.C. 154(b) by 353 days.

(21) Appl. No.: 11/282,771

(22) Filed: Nov. 21, 2005

(65) Prior Publication Data

US 2006/0117973 A1 Jun. 8, 2006

(30) Foreign Application Priority Data

Dec. 2, 2004 (IT) ..... BO2004A0749

(51) Int. Cl.
*B41F 1/34* (2006.01)
*B41F 3/02* (2006.01)

(52) U.S. Cl. ..... 101/485; 101/486; 101/477; 101/480; 101/481

(58) Field of Classification Search ..... 101/382.1, 101/415.1, 477, 480, 481, 485, 486; 382/151, 382/294

See application file for complete search history.

(56) References Cited

U.S. PATENT DOCUMENTS

| | | | | |
|---|---|---|---|---|
| 4,484,522 | A | 11/1984 | Simeth et al. | |
| 4,520,389 | A | 5/1985 | Hornschuh et al. | |
| 5,031,334 | A | 7/1991 | Takamura et al. | |
| 5,633,676 | A * | 5/1997 | Harley et al. | 348/95 |
| 5,676,058 | A * | 10/1997 | Ireton | 101/486 |
| 5,850,789 | A * | 12/1998 | Rudolf et al. | 101/486 |
| 5,887,523 | A * | 3/1999 | Leader et al. | 101/382.1 |
| 6,687,020 | B1 * | 2/2004 | Hanagami et al. | 358/1.2 |
| 6,718,873 | B1 * | 4/2004 | Sambri et al. | 101/375 |
| 7,127,993 | B2 * | 10/2006 | Otten | 101/486 |
| 2001/0054363 | A1 * | 12/2001 | Nakazawa et al. | 101/465 |
| 2003/0179296 | A1 * | 9/2003 | Hill et al. | 348/189 |
| 2004/0004583 | A1 * | 1/2004 | Ogawa et al. | 345/7 |
| 2004/0004626 | A1 * | 1/2004 | Ida et al. | 345/626 |
| 2005/0215879 | A1 * | 9/2005 | Chuanggui | 600/407 |

FOREIGN PATENT DOCUMENTS

| | | | |
|---|---|---|---|
| EP | 0 728 580 | A | 8/1996 |
| EP | 0 999 440 | A | 5/2000 |
| EP | A-1477312 | | 11/2004 |
| FR | 2 657 428 | A | 7/1991 |
| WO | WO 96/04139 | A | 2/1996 |
| WO | WO-A-2005-090079 | | 9/2005 |
| WO | WO 2005/105449 | A | 11/2005 |

* cited by examiner

*Primary Examiner* — Ren Yan
*Assistant Examiner* — David Banh
(74) *Attorney, Agent, or Firm* — Modiano & Associati; Albert Josif; Daniel J. O'Byrne

(57) ABSTRACT

A machine for in-register mounting of flexographic printing plates with a virtual data-processing system, having a supporting footing for a printing plate cylinder, on which a respective flexographic printing plate is mounted, suitable for printing a predefined image, and at least one television camera, which is connected to a monitor, is trained onto the cylinder and can slide parallel to the cylinder to check correct positioning-mounting of the printing plate, the television camera being associated with position sensors and connected to a device for the real-time processing and display of at least one composite image, for allowing the operator to perform precise position comparisons for optimum plate mounting between a preprocessed graphical reproduction of the image to be printed, provided on a digital memory composed of graphical memory associated with position measurements, and the position of the printing plate.

6 Claims, 1 Drawing Sheet

MACHINE FOR IN-REGISTER MOUNTING OF FLEXOGRAPHIC PRINTING PLATES

The present invention relates to a machine for in-register mounting of flexographic printing plates with a virtual data-processing system.

BACKGROUND OF THE INVENTION

Currently, flexographic printing plates for printing machines are generally mounted on the printing plate cylinder by aligning as precisely as possible reference points (for example the traditional registration marks) provided on the printing plates with respective reference markings (often still marked by hand) on the sheets of paper on which the test prints are to be performed.

Modern machines avoid having to perform this alignment of reference markings every time with the naked eye, since optical magnification means are provided or, in the most advanced versions, television cameras are provided which allow to view under magnification the chosen points to be aligned.

Once the fixing of a first printing plate related to one color has been performed correctly and once the test print with said first printing plate has been performed, by way of said optical control means it is possible to verify and optimize the fixing of the printing plates related to the other colors to the respective printing plate cylinders.

It is evident that it is necessary to perform practical overlapping test prints of the image for each cylinder in order to check the achieved result of the in-register mounting of the printing plate; this of course requires considerable time for programming the positions of the printing plates and performing the test prints to check the perfect positioning of each printing plate, and such time is currently no longer acceptable, since it does not allow to achieve the optimum production rates required by the market.

Plate mounting devices, known simply as pointers, have become commercially widespread and allow, after programming the coordinates that correspond to the position of the mounting references, to position automatically the television cameras above the printing plate cylinder. The use of pointers, therefore, requires considerable time for programming, and it is possible only to check the mounting position of the references (for example, the traditional registration marks or microdots).

SUMMARY OF THE INVENTION

The aim of the present invention is to obviate the above-cited drawbacks, by providing a machine which is suitable to mount flexographic printing plates by means of the functional comparison of the image of the printing plate to be mounted, acquired by at least one television camera, and a corresponding digitized reference image.

Within this aim, an object of the present invention is to provide a machine for in-register mounting of flexographic printing plates which allows to position in an optimum manner, and most of all in a single operating step, each flexographic printing plate on the corresponding printing plate cylinder, without having to perform any test print.

Another object of the present invention is to provide a machine for mounting flexographic printing plates which is extremely flexible and versatile as well as simple and intuitive to use and does not have the impression roller (however, the inventive concept can also be associated with conventional machines provided with the impression roller).

Another object of the present invention is to provide a machine which is simple, relatively easy to provide in practice, safe in use, effective in operation, and has a relatively low cost.

This aim and these and other objects that will become better apparent hereinafter are achieved by the present machine for in-register mounting of flexographic printing plates with a virtual data-processing system, of the type comprising a supporting footing for at least one printing plate cylinder, on which a respective flexographic printing plate is mounted which is suitable for printing a predefined image, and at least one movable television camera, which is connected to a monitor and is trained onto said cylinder and can slide parallel to said cylinder in order to check the correct positioning and mounting of the printing plate on said cylinder, characterized in that said movable television camera is associated with position sensing means and is connected functionally to means for the real-time processing and display of at least one composite image, which is suitable to allow the assigned operator to perform precise position comparisons in each instant between a preprocessed graphical reproduction of the image to be printed, provided on a digital memory medium composed of the graphical memory associated with the position measurements, and the position of the printing plate on said printing plate cylinder, so as to achieve the optimum mounting of the printing plate on said cylinder.

BRIEF DESCRIPTION OF THE DRAWINGS

Further characteristics and advantages of the invention will become better apparent from the following detailed description of a preferred but not exclusive embodiment of a machine for the in-register mounting of flexographic printing plates with a virtual data-processing system according to the invention, illustrated by way of non-limiting example in the accompanying drawings, wherein.

In the example of embodiment that follows, individual characteristics may actually be interchanged with other different characteristics that exist in other examples of embodiment.

Moreover, it is noted that anything found to be already known during the patenting process is understood not to be claimed and to be the subject of a disclaimer.

DESCRIPTION OF THE PREFERRED EMBODIMENTS

Figure 2:
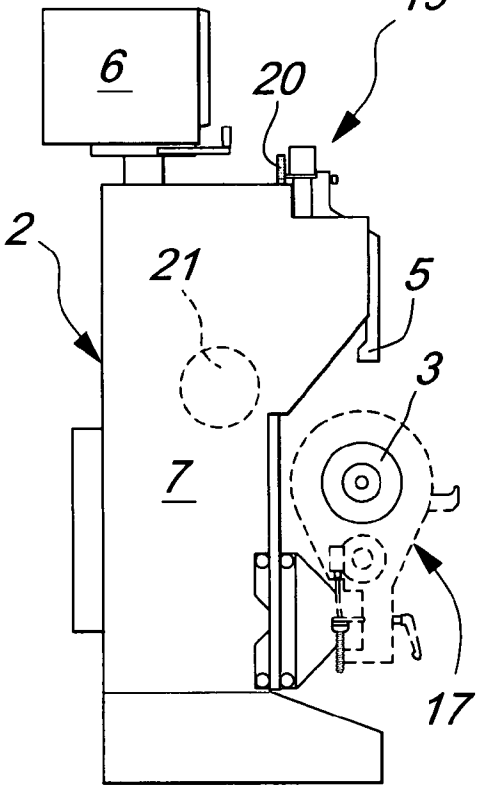
FIG. 2 is a side elevation view of the machine of FIG. 1.
Figure 1:
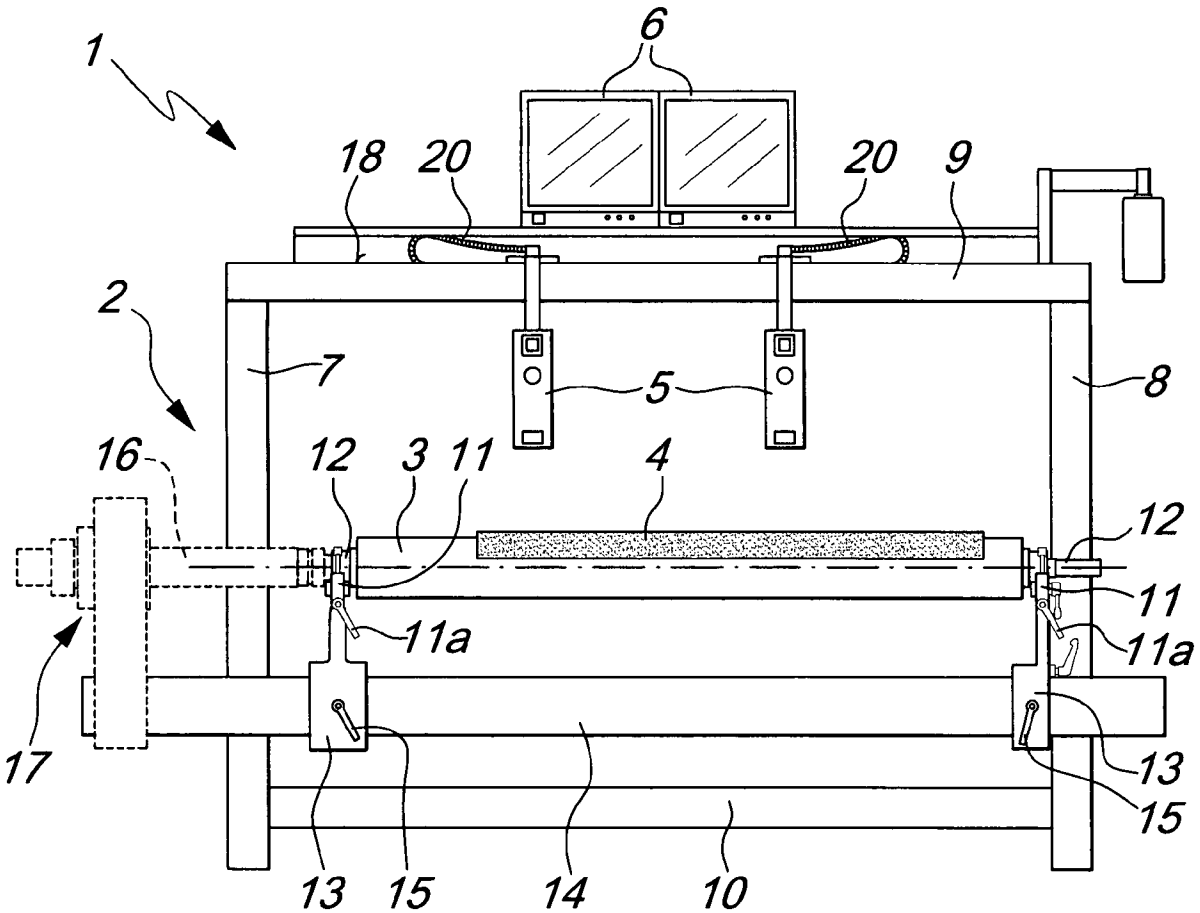
FIG. 1 is a front view of the machine according to the invention.

With reference to FIG. 1, the reference numeral 1 generally and schematically designates a machine for the in-register mounting of flexographic printing plates with a virtual data-processing system according to the invention, in a first embodiment thereof.

The machine comprises a footing, generally designated by the reference numeral 2, for supporting at least one printing plate cylinder 3, on which a flexographic printing plate 4 is mounted which is suitable for printing a predefined image, and at least one movable television camera 5, which is connected to a monitor 6 and is trained on the cylinder 3 and can slide parallel to the cylinder 3 in order to check the correct positioning and mounting of the printing plate.

The footing 2, of a substantially traditional type, is constituted by two vertical posts 7, 8, which are connected by beams 9, 10, and is provided at the front with crescent-shaped supports 11 for the ends 12 of the cylinder 3, said supports being provided with respective upper locking levers 11*a*. The crescent-shaped supports 11 are mounted on respective sliding blocks 13, which can slide on a horizontal lower guide 14, and can be fixed in the chosen position with respect to said guide by way of clamps which can be actuated by means of lower levers 15.

One of the ends 12 of the cylinder 3 is optionally detachably associated, by means of a sort of sleeve 16, with a head for actuating and controlling the rotation of the cylinder 3, which is generally designated by the reference numeral 17 (shown in broken lines) and preferably comprises a motor and a reduction unit, and is suitable for the precise positioning of said cylinder.

The machine comprises advantageously two movable television cameras 5, both of which can slide along an upper guide 18, which is parallel to the axis of the cylinder 3. Each one of the television cameras 5 is associated with translational motion means, generally designated by the reference numeral 19, of the substantially known type and comprising two articulated cable supporting chains 20.

According to the invention, each one of the movable television cameras 5 is advantageously associated with position sensing means (for example, an encoder or an optical-scale device, or a magnetic-scale device) and is functionally connected to means for displaying in real time on the monitor 6 and for processing at least one composite image, which is suitable to allow the operator assigned to mounting the printing plate 4 to perform accurate position comparisons in each instant between a preprocessed graphical reproduction of the image to be printed, provided on a digital memory medium composed of the graphical memory associated with the position values, and the position of the printing plate on the printing plate cylinder, so as to achieve the optimum mounting of the printing plate on the cylinder.

This allows to achieve, in a single operating step, the precise positioning, one after the other, of each printing plate 4 related to each color on the respective printing plate cylinder 3, obtaining the required image (i.e., an image which matches the preprocessed graphical reproduction) without necessarily having to perform numerous and expensive test prints in order to check the correctness of the mountings.

The display and processing means conveniently comprise at least one computerized central processing unit, not shown in the figures for the sake of simplicity, which is suitable to load into memory the preprocessed graphical reproduction, which is available on the digital medium, and to provide the composite image by providing a sort of transparent overlay of the graphical reproduction with the image acquired by the television cameras 5 trained on the printing plate 4. The computerized central processing unit can also be of the substantially traditional type, provided with suitable software for generating the composite image.

Conveniently, the digital memory medium is constituted by at least one graphical file, which is available to the machine and readable by it, for example by means of a floppy disk or on a compact disc, or by way of other equivalent means.

The composite image, which is visible in each instant on the monitors 6 to the assigned operator and is suitable for comparison between the preprocessed graphical reproduction of the printout and the image projected by the television cameras 5, has, merely by way of non-limiting example, a substantially checkered structure, which comprises alternately sorts of frames which bear portions of said preprocessed graphical reproduction and sorts of frames in which it is possible to view in real time the image of the flexographic printing plate 4 on the printing plate cylinder 3.

The operation of the machine according to the invention is intuitive. First of all, the digital memory medium related to the graphical reproduction of the print, provided in practice on a floppy disk, compact disc or the like, is loaded into the memory of the computerized central processing unit. The television cameras 5 are then activated in the appropriate positions with respect to the upper guide 18, training them onto the printing plate cylinder 3; then the printing plate 4 is mounted on the cylinder 3 while observing on the monitor 6 the composite image, which bears portions of the digital graphical reproduction of the print mixed with portions of the actual image projected at each instant by the television cameras 5.

In this way, the assigned operator, by means of small and precise movements of the printing plate 4 on the cylinder 3, can align exactly the digital graphical reproduction of the print with the actual image of the printing plate 4 (by taking for example as reference the traditional registration marks), without performing test prints. This operation is repeated in succession for each printing plate 4 related to each color, assembling precisely the final image to be printed and always having the digital graphical reproduction loaded in memory as a reliable reference.

It has thus been shown that the invention achieves the proposed aim and objects.

The machine allows to mount each printing plate rapidly, reliably and precisely without having to check subsequently the correctness of the positioning with expensive and time-consuming print tests. The machine therefore allows to achieve a reduction in printing costs and in operating times.

The machine according to the invention allows to use the graphics of the images of the various colors that has been preprocessed (in particular, selected by means of a scanner) and used to produce said printing plates and the printing plate position program. It is therefore evident that various advantages are achieved. First of all, it is no longer necessary to produce the printing plate position program, since the program already provided in the graphics department is used.

Further, the test print is performed "virtually", i.e., by using the preprocessed graphical image compared with the actual image generated on the photopolymer printing plate.

Further, it is noted that it is not necessary to motorize the television cameras in order to actuate their movement into position.

Finally, it is not indispensable for the rotation of the printing plate cylinder to be motorized; however, the invention can also be applied to machines which are already commercially available and are provided with a motor drive.

The invention thus conceived is susceptible of numerous modifications and variations, all of which are within the scope of the appended claims.

The machine can be provided optionally with a proof-press 21 with an impression roller, not shown in detail because it is of a fully traditional type, which is supported rotatably by the uprights 7, 8; the impression roller has an axis which is parallel to the axis of the printing plate cylinder 3 and is suitable to be covered with sheets of printing paper. The printing plate cylinder 3 and the impression roller can move with respect to each other from at least one position for mounting the printing plate 4 on the cylinder 3 to a printing position, in which they are arranged in contact along respective generatrices.

Moreover, the machine can be provided optionally with a device for the assisted mounting of the printing plate 4 on the cylinder 3; the device comprises advantageously at least one contrast roller, which is actuated, by way of pusher means (for example of the pneumatic type) so as to press against the cylinder 3 along respective generatrices, so as to eliminate any air pockets formed between the cylinder 3 and the printing plate 4.

All the details may be replaced with other technically equivalent ones.

The embodiment of the present invention shall be carried out in the most scrupulous compliance with the statutory and regulatory provisions related to the products of the invention or correlated thereto and following any required authorization of the corresponding competent authorities, with particular reference to regulations related to safety, environmental pollution and health.

In practice, the materials used, as well as the shapes and the dimensions, may be any according to requirements without thereby abandoning the scope of the protection of the appended claims.

The disclosures in Italian Patent Application No. BO2004A000749 from which this application claims priority are incorporated herein by reference.

What is claimed is:

1. A machine for in-register mounting of flexographic printing plates with a virtual data-processing system, comprising:

at least one printing plate cylinder;

a supporting footing for said at least one printing plate cylinder;

a respective flexographic printing plate mounted on said at least one plate cylinder and which is suitable for printing a predefined image;

a monitor;

at least one movable television camera that is connected to said monitor, said at least one television camera being trained onto said at least one cylinder and being slideable parallel to said at least one cylinder in order to check a correct positioning and mounting of the printing plate on said at least one cylinder;

position sensing means associated with said at least one movable television camera;

a digital memory medium composed of a graphical memory associated with positioning measurements, said digital memory medium including a digitized preprocessed graphical reproduction reference for an image to be printed to which an actual image of said printing plate projected by said at least one movable television camera is to be matched; and a processing and display means that is connected functionally to said digital memory medium and to said at least one television camera for real-time processing and instantaneous display of at least one composite image, said processing and display means being configured to provide said at least one composite image and to display said at least one composite image in real-time on said monitor wherein said at least one composite image is formed by mixing and overlaying portions of said actual image obtained continuously and in real-time by the television camera and portions of said preprocessed graphical reproduction reference for the image to be printed, whereby an assigned operator continuously performs a precise position comparison between said preprocessed graphical reproduction reference for the image to be printed and said actual image overlaid thereon and adjusts a position of the printing plate on said at least one printing plate cylinder to align said actual image with said preprocessed graphical reproduction reference the image to be printed to achieve an optimum mounting of the printing plate on said at least one plate cylinder;

wherein said display and processing means comprise at least one computerized central processing unit which is adapted to load into said digital memory medium said preprocessed graphical reproduction reference image and to provide said composite image by generating a transparent overlay of said graphical reproduction reference image with the actual image acquired by said television camera trained onto said printing plate.

2. The machine of claim 1, wherein said digital memory medium is constituted by at least one file of a graphical type.

3. The machine of claim 1, comprising an upper guide which is parallel to the axis of said cylinder and at least two of said television cameras, which are actuated so as to slide along a same said upper guide.

4. The machine of claim 3, wherein each one of said television cameras is associated with a respective said display monitor.

5. The machine of claim 3, wherein said television cameras are associated with a said monitor which is suitable to display two images.

6. The machine of claim 1, comprising a head for actuating and controlling rotation of said at least one plate cylinder for its precise positioning.

* * * * *